US008061835B2

(12) United States Patent
Nakashima

(10) Patent No.: US 8,061,835 B2
(45) Date of Patent: Nov. 22, 2011

(54) INKJET RECORDING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1135 days.

(21) Appl. No.: 11/837,839

(22) Filed: Aug. 13, 2007

(65) Prior Publication Data

US 2008/0043084 A1 Feb. 21, 2008

(30) Foreign Application Priority Data

Aug. 16, 2006 (JP) ..... 2006-221824

(51) Int. Cl.

| | |
|---|---|
| ***B41J 2/01*** | (2006.01) |
| ***B65H 1/00*** | (2006.01) |
| ***B65H 5/00*** | (2006.01) |
| ***B65H 9/00*** | (2006.01) |

(52) U.S. Cl. ..... 347/104; 271/8.1; 271/225; 271/226

(58) Field of Classification Search ..... None
See application file for complete search history.

(56) References Cited

U.S. PATENT DOCUMENTS

| | | | | |
|---|---|---|---|---|
| 5,820,282 | A * | 10/1998 | Nakai | 400/642 |
| 6,019,466 | A | 2/2000 | Hermanson | |
| 6,129,461 | A * | 10/2000 | Nakai | 400/59 |
| 2005/0001892 | A1 | 1/2005 | Yoshihisa et al. | |
| 2006/0115304 | A1 | 6/2006 | Ahn et al. | |

FOREIGN PATENT DOCUMENTS

| | | | |
|---|---|---|---|
| CN | 1541848 | A | 11/2004 |
| CN | 1782900 | A | 6/2006 |
| JP | 11268307 | A | 10/1999 |

OTHER PUBLICATIONS

The State Intellectual Property Office of the People'S Republic of China; Notification of the Second Office Action for Patent Application No. CN200710141097.8, dated Dec. 29, 2010. (counterpart to above-captioned U.S. patent application).

State Intellectual Property Office of the People's Republic of China; Notification of First Office Action in Chinese Patent Application No. 200710141097.8 (counterpart to the above-captioned U.S. patent application) mailed Jun. 5, 2009.

The State Intellectual Property Office of the People's Republic of China, Notification of the Third Office Action for Chinese Patent Application No. 200710141097.8 (counterpart to above-captioned patent application), issued Apr. 28, 2011.

* cited by examiner

*Primary Examiner* — Matthew Luu
*Assistant Examiner* — Kendrick Liu
(74) *Attorney, Agent, or Firm* — Baker Botts L.L.P.

(57) ABSTRACT

An inkjet recording apparatus includes: (a) a medium supporter; (b) an inkjet head; and (c) a medium feeder including a first roller and a second roller for cooperating with each other to nip the recording medium, for thereby feeding a recording medium outwardly of the medium supporter. The first roller is displaceable between a projecting position and a non-projecting position, such that the first roller projects out from the medium supporter when being placed in the projecting position. The inkjet recording apparatus further includes (d) a feeder controller configured to control the medium feeder, for causing the second roller to be displaced toward the first roller upon placement of the first roller in the projecting position so as to cooperate with the first roller to nip the recording medium, and causing the first roller and/or the second roller to be rotated, whereby the recording medium is fed outwardly of the medium supporter while the recording medium is being at least partially separated from the medium supporter by the placement of the first roller in the projecting position.

12 Claims, 8 Drawing Sheets

INKJET RECORDING APPARATUS

This application claims priority from Japanese Patent Application No. 2006-221824 filed on Aug. 16, 2006, the disclosure of which is herein incorporated by reference in its entirety.

BACKGROUND OF THE INVENTION

1. Field of the Invention

The present invention relates to an inkjet recording apparatus for performing a recording operation by ejecting ink toward a recording medium.

2. Discussion of Related Art

U.S. Pat. No. 6,019,466 (corresponding to JP-H11-268307A) discloses a multicolor liquid ink printer including: a stationary platen; drive rollers for moving a media sheet on the platen; a charging device for producing electrostatic charge; full width array printheads; and a carriage that carries the charging device and the printheads, so that a printing operation is performed by the printheads onto the media sheet (recording medium such as standard paper sheet) which is held on the platen. In this printer, after having been fed onto the platen, the media sheet is electrostatically held on the platen, owing to electrostatic charge that is produced by the charging device and applied onto the media sheet. A desired image is formed on the media sheet by the printheads while the media sheet is held on the platen. The printing operation is completed when the sheet having the formed image is moved by the drive rollers, from the platen to an output tray of the printer.

SUMMARY OF THE INVENTION

In the above-described printer disclosed in U.S. Pat. No. 6,019,466, the media sheet is held down electrostatically on the platen, so as to stick onto the platen. Therefore, when the media sheet is to be moved by the drive rollers, toward the output tray, the media sheet cannot be easily separated from the platen, thereby requiring a large length of time for moving the media sheet away from the platen toward the output tray. It might be possible to increase a movement force applied from the drive rollers to the media sheet, so as to cause the media sheet to be quickly separated from the platen. However, the increase of the movement force could cause wrinkling or cockling in portions of the media sheet that are in contact with the drive rollers, thereby resulting in poor quality in the media sheet having the image formed thereon.

The present invention was made in view of the background prior art discussed above. It is therefore an object of the invention to provide an inkjet recording apparatus having arrangements enabling quick feed movement of a recording medium away from a medium supporter. This object may be achieved according to a principle of the invention that is described below.

The principle of the invention provides an inkjet recording apparatus including: (a) a medium supporter configured to support a recording medium that is to be in close contact with a flat surface of the medium supporter; (b) an inkjet head having a nozzle opening surface that is opposed to the flat surface of the medium supporter; (c) a medium feeder including a first roller and a second roller that are configured to cooperate with each other to nip the recording medium supported on the flat surface of the medium supporter, for thereby feeding the recording medium outwardly of the flat surface of the medium supporter; (d) the first roller being displaceable between a projecting position and a non-projecting position, such that the first roller projects out from the flat surface of the medium supporter toward the nozzle opening surface of the inkjet head when the first roller is placed in the projecting position, and such that the first roller does not project out from the flat surface when the first roller is placed in the non-projecting position; (e) the second roller being displaceable toward and away from the first roller; and (f) a feeder controller configured to control the medium feeder, for causing the first roller to be placed in the projecting position, causing the second roller to be displaced toward the first roller upon placement of the first roller in the projecting position so as to cooperate with the first roller to nip the recording medium, and causing at least one of the first and second rollers to be rotated, whereby the recording medium is fed outwardly of the flat surface while the recording medium is being at least partially separated from the flat surface by the placement of the first roller in the projecting position.

In the present inkjet recording apparatus, with the first roller being displaced to the projecting position, the recording medium is pressed by the first roller toward the nozzle opening surface of the inkjet head, so as to be at least partially separated from the flat surface of the medium supporter. Then, with displacement of the second roller toward the first roller so as to cooperate with the first roller to nip the recording medium, the recording medium is nipped between the first and second rollers, for thereby establishing a state in which a rotational force can be transmitted from the first roller to the recording medium. By causing at least one of the first and second rollers to be rotated with this state being established, it is possible to quickly feed the recording medium outwardly of the flat surface of the medium supporter.

According to an advantageous arrangement of the principle of the invention, the medium supporter has a through-hole that opens in the flat surface, wherein the first roller projects out from the flat surface through the through-hole during the placement of the first roller in the projecting position. In the inkjet recording apparatus constructed according to this advantageous arrangement, it is possible to establish a simple construction that enables the recording medium to be easily separated at least a part thereof from the flat surface of the medium supporter.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

There will be described an inkjet printer 1 that is constructed according to an embodiment of the invention, by reference to the accompanying drawings. It is noted that, in the following description, there will be used terms "upper", "lower", "right", "left", "front" and "rear" directions of the inkjet printer 1 that are indicated by respective arrows "UP", "DOWN", "RIGHT", "LEFT", "FRONT" and "REAR" in FIGS. 1 and 2.

Figure 1:
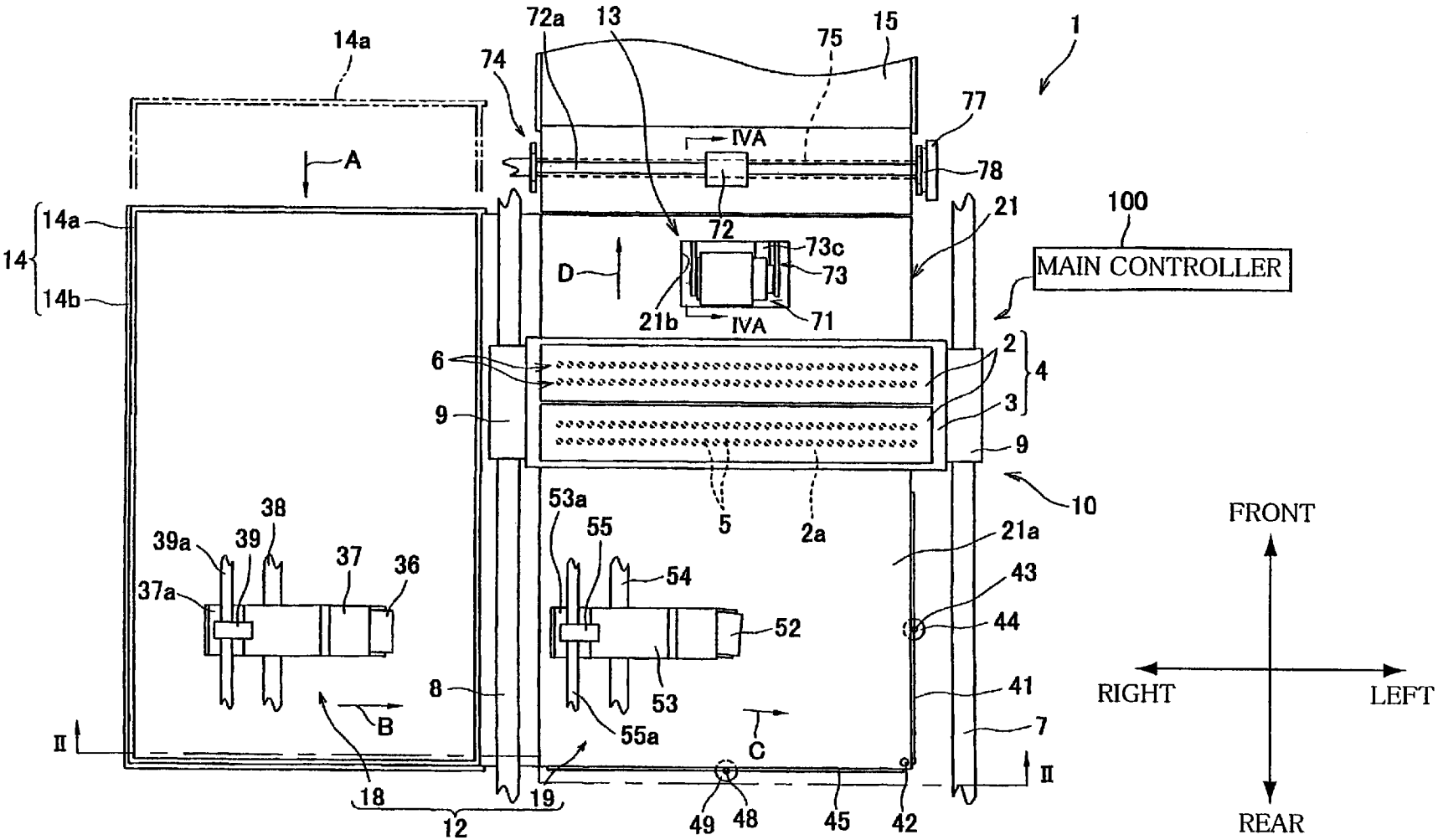
FIG. 1 is a plan view schematically showing an internal structure of an inkjet printer that is constructed according to an embodiment of the present invention.

As shown in FIG. 1, the inkjet printer 1 is a full color inkjet printer of line type equipped with two inkjet heads 2 each elongated in right and left directions of the inkjet printer 1.

The printer 1 includes an input sheet accommodator 14 as a first medium accommodator, a platen 21 as a medium supporter and an output sheet accommodator 15 as a second medium accommodator. The input sheet accommodator 14 is disposed in a right side portion of the printer 1, so as to accommodate a plurality of media sheets P as recording media. The platen 21 is disposed on a left side of the input sheet accommodator 14, and has an upper surface 21*a* as a flat surface. The output sheet accommodator 15 is disposed in a front side of the platen 21.

The printer 1 further includes a head mover 10, a sheet loading feeder 12, a sheet unloading feeder 13 as a medium feeder and a main controller 100. The head mover 10 is configured to move the inkjet heads 2 in forward and rearward directions of the printer 1. The sheet loading feeder 12 is configured to horizontally feed the media sheets P from the input sheet accommodator 14 onto the platen 21. The sheet unloading feeder 13 is configured to horizontally feed the media sheets P from the platen 21 to the output sheet accommodator 15. The operations of the head mover 10, the sheet loading feeder 12 and the sheet unloading feeder 13 are controlled by the main controller 100.

Figure 2:
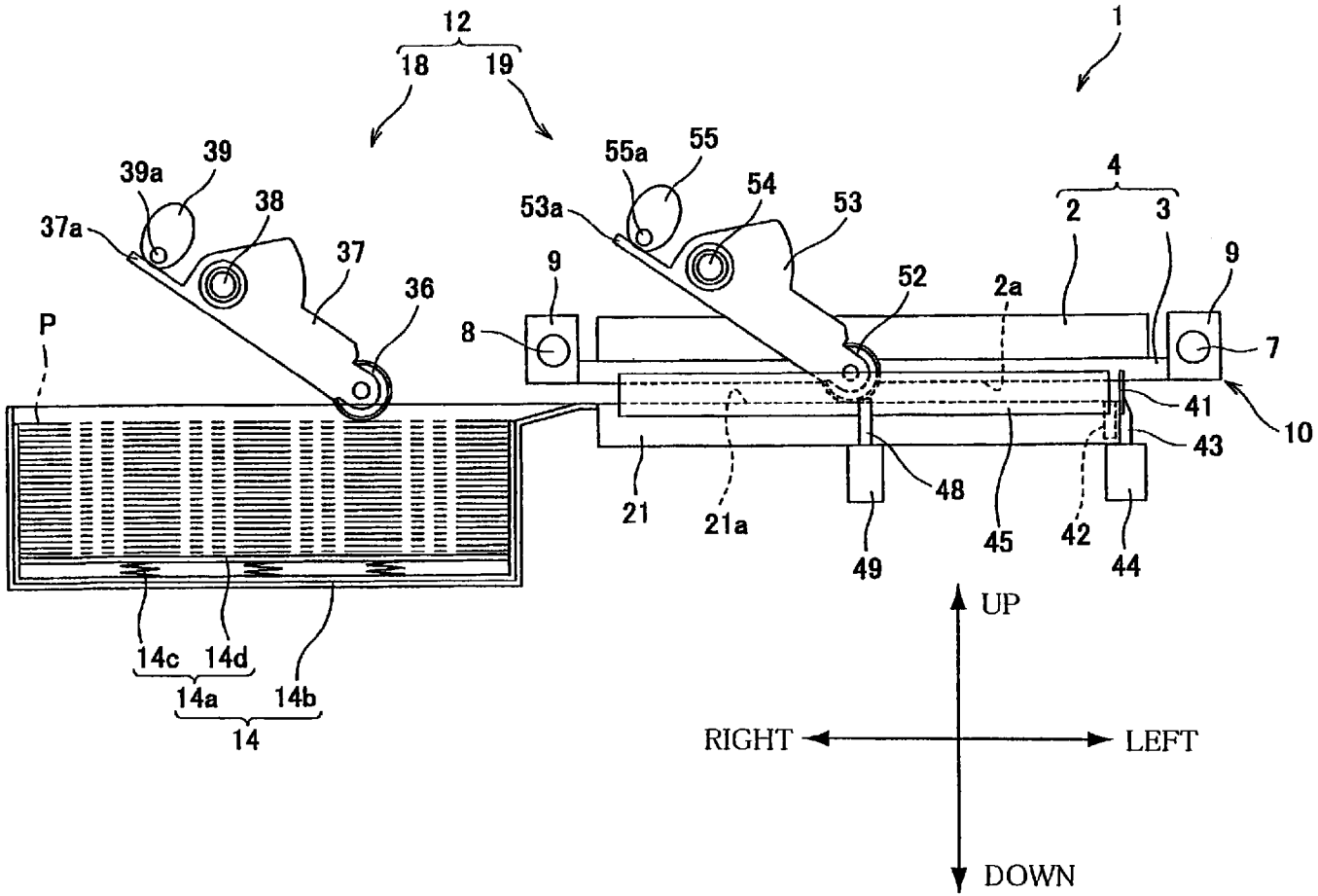
FIG. 2 is a cross sectional view taken along line II-II in FIG. 1.

The input sheet accommodator 14 has a box-like shaped tray 14*a* that opens upwardly and a tray holder 14*b* that holds the tray 14*a*, such that the tray 14*a* is slidable relative to the tray holder 14*b* in the forward and rearward directions. The tray 14*a* has an elongated rectangular shape as seen in a plan view, and is elongated in a direction in which the tray 14*a* is moveable relative to the tray holder 14*b*. In the tray 14*a*, the media sheets P are accommodated such that a longitudinal direction of each media sheet P in the direction in which the tray 14*a* is elongated. The tray 14*a* has a spring 14*c* and a bottom plate 14*d* that is upwardly biased by the spring 14*c*, as shown in FIG. 2, so that the media sheets P accommodated in the tray 14*a* are upwardly biased. When the media sheets P are to be accommodated in the input sheet accommodator 14, the tray 14*a* is forwardly drawn out of the tray holder 14*b*, and the media sheets P are set in the tray 14*a*. Then, the tray 14*a* is moved rearwardly in a medium introducing direction A to be introduced into the tray holder 14*b*. Thus, the input sheet accommodator 14 as the first medium accommodator is configured to receive the media sheets P introduced thereinto in the medium introducing direction A. The tray holder 14*b* has an medium introducing opening which faces an upstream side of the tray holder 14*b* in the medium introducing direction A and which allows introduction of the media sheets P into the tray holder 14*b* therethrough in the medium introducing direction A.

As shown in FIGS. 1 and 2, the sheet loading feeder 12 includes a first loader 18 and a second loader 19. The first loader 18 is configured to supply the media sheets P accommodated in the input sheet accommodator 14 toward in a leftward direction of the printer 1, i.e., a first medium loading direction B that is perpendicular to the medium introducing direction A. The second loader 19 is configured to feed the media sheets P supplied by the first loader 18, onto the platen 21.

The first loader 18 includes a pickup roller 36 for picking up an uppermost one of the media sheets P accommodated in the input sheet accommodator 14, so as to supply the media sheets P one after another toward the platen 21. The first loader 18 further includes a pickup roller holder 37 that rotatably holds the pickup roller 36, a drive shaft 38 that pivotably holds the pickup roller holder 37, a cam 39 that is configured to cause the pickup roller holder 37 to be pivoted about the drive shaft 38.

The pickup roller 36 is located in a position that is rearwardly deviated from a longitudinal center of the input sheet accommodator 14 (see FIG. 1). When the tray 14*a* is entirely introduced in the tray holder 14*b*, the pickup roller 36 is brought into contact with an uppermost one of the media sheets P accommodated in the input sheet accommodator 14. The pickup roller 36 is rotatable about a shaft that is parallel to the medium introducing direction A. The media sheets P are moved in the first medium loading direction B by rotation of the pickup roller 36.

The pickup roller 36 is rotatably held by one of opposite end portions of the pickup roller holder 37. The other of the opposite end portions of the pickup roller holder 37 provides a contact portion 37*a* that is held in contact with an outer circumferential surface of the cam 39. The cam 39 is fixed, at a portion close to its periphery, to a rotary shaft 39*a*, so that the cam 39 is rotated with rotation of the rotary shaft 39*a*. The pickup roller holder 37 has three gears (not shown) meshing with each other, one of which is fixed to the drive shaft 38 so as to be given a rotational force by the drive shaft 38, and the other two of which are arranged to transmit the rotational force to the pickup roller 36. That is, the drive shaft 38 cooperates with the three gears to constitute a first rotational force applier that is configured to apply the rotational force to the pickup roller 36 such that the media sheets P are fed by rotation of the pickup roller 36.

In the first loader 18 constructed as described above, the pickup roller 36 is rotated in counterclockwise direction as seen in FIG. 2, when the drive shaft 38 is rotated in clockwise direction as seen in FIG. 2. In this instance, if the pickup roller 36 is held in contact with the media sheets P, an upper most one of the media sheets P is fed toward the platen 21 by the rotation of the pickup roller 36.

The second loader 19 includes a loading roller 52 for loading the media sheets P picked up by the pickup roller 36, onto the upper surface 21*a* of the platen 21. The second loader 19 further includes a loading roller holder 53 that rotatably holds the loading roller 52, a drive shaft 54 that pivotably holds the loading roller holder 53, a cam 55 that is configured to cause the loading roller holder 53 to be pivoted about the drive shaft 54.

The loading roller 52 is located in a position that is rearwardly deviated from a longitudinal center of the platen 21.

The loading roller 52 is rotatable about a shaft that is slightly inclined with respect to the medium introducing direction A. The media sheets P are moved in a second medium loading direction C by rotation of the loading roller 52. The second medium loading direction C is parallel to neither the medium introducing direction A nor the first medium loading direction B. That is, the second medium loading direction C is inclined such that the media sheet P is forced rearwardly when being moved in a leftward direction of the printer 1 by the rotation of the loading roller 52, whereby the media sheet P is brought into contact with a stopper as a medium positioner that includes a longitudinally extending portion 41 as a first portion and a widthwise extending portion 45 as a second portion, so as to be reliably positioned in a predetermined position.

The loading roller 52 is rotatably held by one of opposite end portions of the loading roller holder 53. The other of the opposite end portions of the loading roller holder 53 provides a contact portion 53*a* that is held in contact with an outer circumferential surface of the cam 55. The cam 55 is fixed, at a portion close to its periphery, to a rotary shaft 55*a*, so that the cam 55 is rotated with rotation of the rotary shaft 55*a*. The loading roller holder 53 has three gears (not shown) meshing with each other, one of which is fixed to the drive shaft 54 so as to be given a rotational force by the drive shaft 54, and the other two of which are arranged to transmit the rotational force to the loading roller 52. That is, the drive shaft 54 cooperates with the three gears to constitute a second rotational force applier that is configured to apply the rotational force to the loading roller 52 such that the media sheets P are fed by rotation of the loading roller 52.

In the second loader 19 constructed as described above, the loading roller 52 is rotated in counterclockwise direction as seen in FIG. 2, when the drive shaft 54 is rotated in clockwise direction as seen in FIG. 2. In this instance, if the loading roller 52 is held in contact with the media sheet P so as to cooperate with the upper surface 21*a* of the platen 21 to grip the media sheet P, the media sheet P is fed toward a left end of the platen 21 by the rotation of the loading roller 52.

Figure 3:
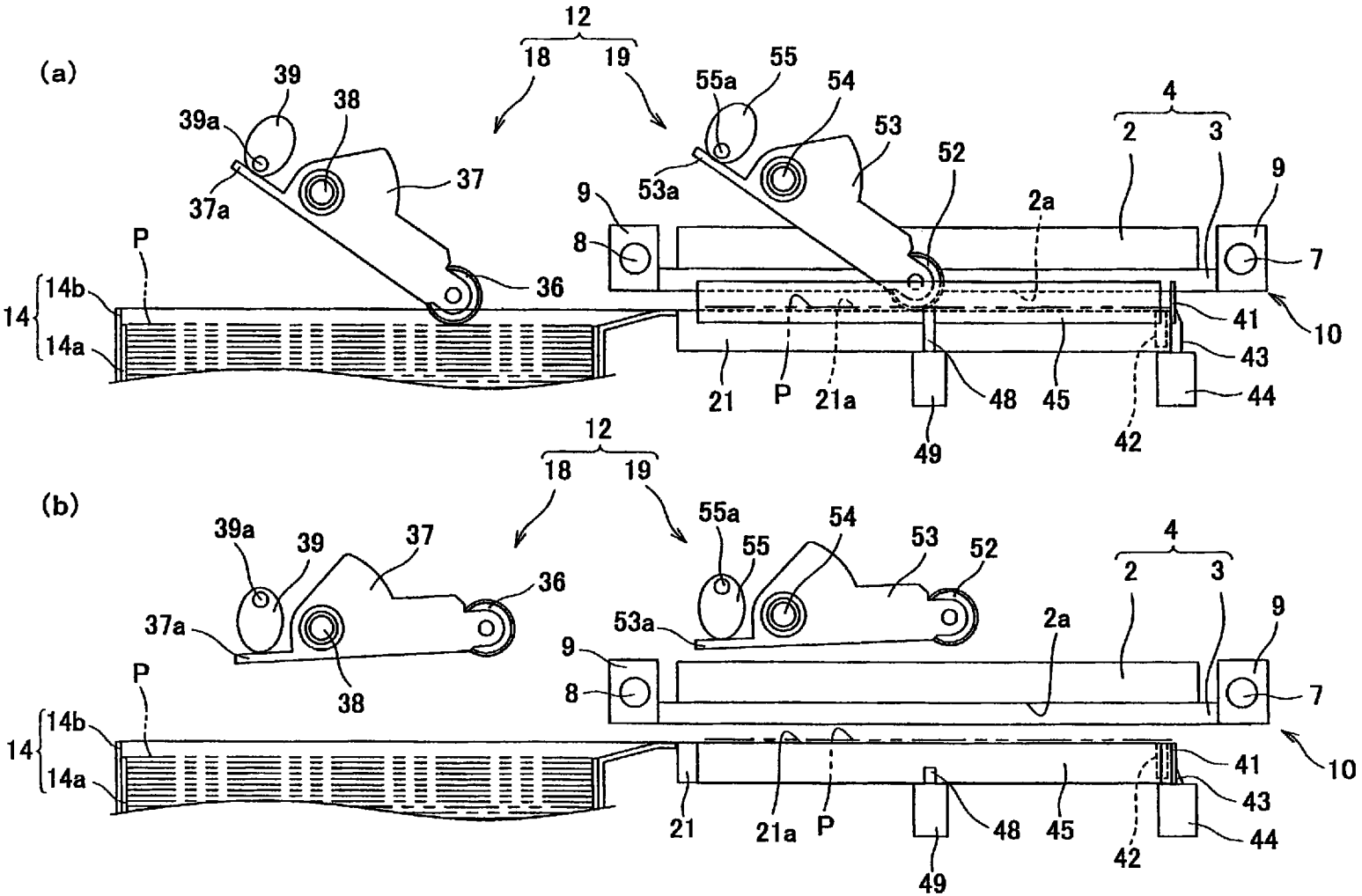
FIG. 3 is a set of views showing operations of first and second loaders of a sheet loading feeder of the inkjet printer of FIG. 1.

FIG. 3 is a set of views showing operations of first and second loaders 18, 19 of the sheet loading feeder 12. As shown in the views of FIG. 3, with the cams 39, 55 being rotated under control of the main controller 100, the pickup roller holder 37 and loading roller holder 53 are pivotable about the drive shafts 38, 54 in a direction that causes the contact portions 37*a*, 53*a* to be moved toward the rotary shafts 39*a*, 55*a* and in a direction that causes the contact portion 37*a*, 53*a* to be moved away from the rotary shafts 39*a*, 55*a*. When a distant between the contact portion 37*a* and the rotary shaft 39*a* is minimized, the pickup roller 36 held by the pickup roller holder 37 is placed in its contact position in which the roller 36 is in contact with an uppermost one of the media sheets P accommodated in the input sheet accommodator 14 (see view (a) of FIG. 3). Similarly, when a distant between the contact portion 53*a* and the rotary shaft 55*a* is minimized, the loading roller 52 held by the loading roller holder 53 is placed in its contact position in which the roller 53 is in contact with the media sheet P on the upper surface 21*a* of the platen 21 (see view (a) of FIG. 3).

On the other hand, when the distance between the contact portion 37*a* and the rotary shaft 39*a* is maximized, the pickup roller 36 held by the pickup roller holder 37 is placed in its distant position which is distant from the media sheets P accommodated in the input sheet accommodator 14 and which is higher than a height position of the inkjet heads 2 (see view (b) of FIG. 3). Similarly, when the distance between the contact portion 53*a* and the rotary shaft 55*a* is maximized, the loading roller 52 held by the loading roller holder 53 is placed in its distant position which is distant from the media sheet P and which is higher than the height position of the inkjet heads 2 (see view (b) of FIG. 3).

It is noted that the first loader 18 does not necessarily have to be located in a position higher than the inkjet heads 2 as long as the first loader 18 is located in a position higher than the tray 14*a* of the input sheet accommodator 14. With the loading roller 52 being placed in the distant position that is higher than the height position of the inkjet heads 2, as described above, horizontal movement of the inkjet heads 2 relative to the platen 21 is not impeded by the loading roller 52. That is, it is possible to avoid the inkjet heads 2 from being interfered by the loading roller 52.

The platen 21 has electrodes (not shown) built therein, so that the platen 21 is electrified with application of direct-current voltage between the electrodes, whereby an attraction force is applied between the upper surface 21*a* and the media sheet P that is placed on the upper surface 21*a*. The electrodes cooperates with a direct-current voltage generating circuit 108 (see FIG. 6) to constitute an attraction force applier that is configured to produce electrostatic charge for applying the attraction force between the upper surface 21*a* and the media sheet P. As shown in FIG. 1, the platen 21 has a rectangular shape, as seen in the plan view, which is elongated in a direction parallel to the above-described medium introducing direction A. The platen 21 has a length (as measured in the medium introducing direction A) that is substantially the same to that of the tray 14*a*. The platen 21 has a width (as measured in the first medium loading direction B) that is slightly larger than that of the tray 14*a*. In a left end portion and a rear end portion of the platen 21, the above-described longitudinally extending portion 41 and widthwise extending portion 45 of the stopper are provided, respectively, with which the media sheet P fed by the second loader 19 of the sheet loading feeder 12 are to be brought into contact. The media sheet P is positioned in the predetermined position by the stopper, with its leading end and lateral end (its left end and rear end) being brought into contact with the respective longitudinally extending portion 41 and widthwise extending portion 45 of the stopper.

The longitudinally extending portion 41 of the stopper is provided by an elongated plate member which is disposed in a left end portion of the platen 21 and extends from substantially a center of the left end portion to a rear end portion of the platen 21, as shown in FIG. 1. A piston 43 of a solenoid 44 is fixed to a central portion of the longitudinally extending portion 41. When the piston 43 is placed in its extending position, as shown in view (a) of FIG. 3, the longitudinally extending portion 41 of the stopper is placed in its projecting position, so as to project out from the upper surface 21*a* of the platen 21. The placement of the longitudinally extending portion 41 in the projecting position means that the same portion 41 is placed in its positioning state for positioning the media sheet P which is fed by the loading roller 52 in the second medium loading direction C which is brought into contact at is leading end with the same portion 41. On the other hand, when the piston 43 is placed in its retracted position, as shown in view (b) of FIG. 3, the longitudinally extending portion 41 of the stopper is placed in its non-projecting position, so as not to project out from the upper surface 21*a* of the platen 21. The placement of the longitudinally extending portion 41 in the non-projecting position means that the same portion 41 is placed in its non-positioning state for not impeding the movement of the inkjet heads 2. That is, during the placement of the longitudinally extending portion 41 in the non-positioning state, the inkjet heads 2 are not interfered by the same portion 41 of the stopper.

The widthwise extending portion 45 of the stopper is provided by an elongated plate member which is disposed in a rear end portion of the platen 21 and extends throughout substantially entirety of the rear end portion of the paten 21, as shown in FIG. 1. A piston 48 of a solenoid 49 is fixed to a central portion of the widthwise extending portion 45. When the piston 48 is placed in its extending position, as shown in view (a) of FIG. 3, the widthwise extending portion 45 of the stopper is placed in its projecting position, so as to project out from the upper surface 21*a* of the platen 21. The placement of the widthwise extending portion 45 in the projecting position means that the same portion 45 is placed in its positioning state for positioning the media sheet which is fed by the loading roller 52 in the second medium loading direction C which is brought into contact at its lateral end with the same portion 45. On the other hand, when the piston 48 is placed in its retracted position, as shown in view (b) of FIG. 3, the widthwise extending portion 45 of the stopper is placed in its non-projecting position, so as not to project out from the upper surface 21*a* of the platen 21. The placement of the widthwise extending portion 45 in the non-projecting position means that the same portion 45 is placed in its non-positioning state for not impeding the movement of the inkjet heads 2. That is, during the placement of the widthwise extending portion 45 in the non-positioning state, the inkjet heads 2 are not interfered by the same portion 45 of the stopper. Thus, each of the longitudinally and widthwise extending portions 41, 45 has a simple construction that establishes a selected one of its protruding and non-protruding positions and a selected one of the positioning and non-positioning states.

A sensor 42 as a detector is provided in a position which is close to ends of the respective longitudinally and widthwise extending portions 41, 45 of the stopper and which is an upstream side of the longitudinally extending portion 41 in the medium loading direction. Owing to the provision of the sensor 42, it is possible to determine whether the media sheet P fed by the loading roller 52 is actually positioned in the predetermined position by the stopper as the medium positioner. In this sense, the sensor 42 may be considered to constitute a determiner for determining whether the media sheet P is positioned in the predetermined position.

The platen 21 has a through-hole 21*b* that opens in the upper surface 21*a*, as shown in FIG. 1. The through-hole 21*b* is located in a position which is located in a widthwise center of the platen 21 and which is close to the output sheet accommodator 15. The through-hole 21 is a rectangular shape, as seen in the plan view of the printer 1, which is elongated in the widthwise direction of the platen 21. In the through-hole 21, there is provided a sheet unloading roller 71 of the sheet unloading feeder 13. It is noted that the through-hole 21*b* has a center that is aligned with not only a center line of the upper surface 21*a* of the platen 21 parallel with the longitudinal direction of the media sheet P but also a center line of the media sheet P parallel with the longitudinal direction of the media sheet P.

Figure 4A:
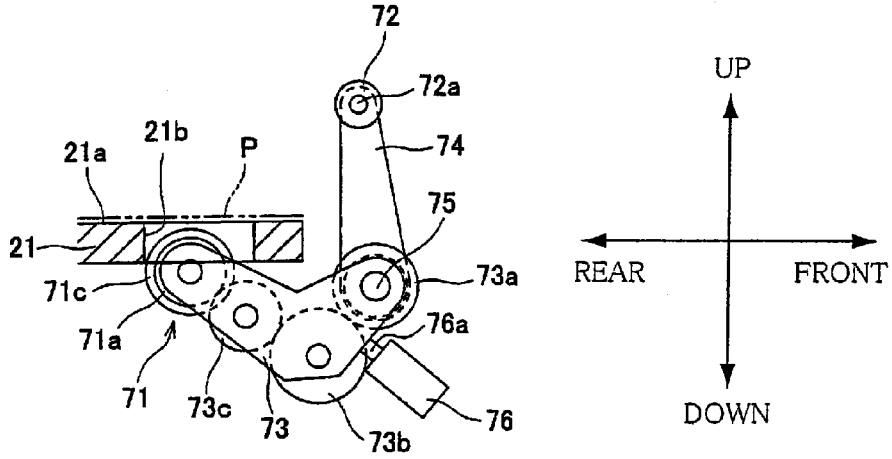
FIG. 4A is a cross sectional view showing a sheet unloading feeder and taken along line IVA-IVA in FIG. 1.
Figure 4B:
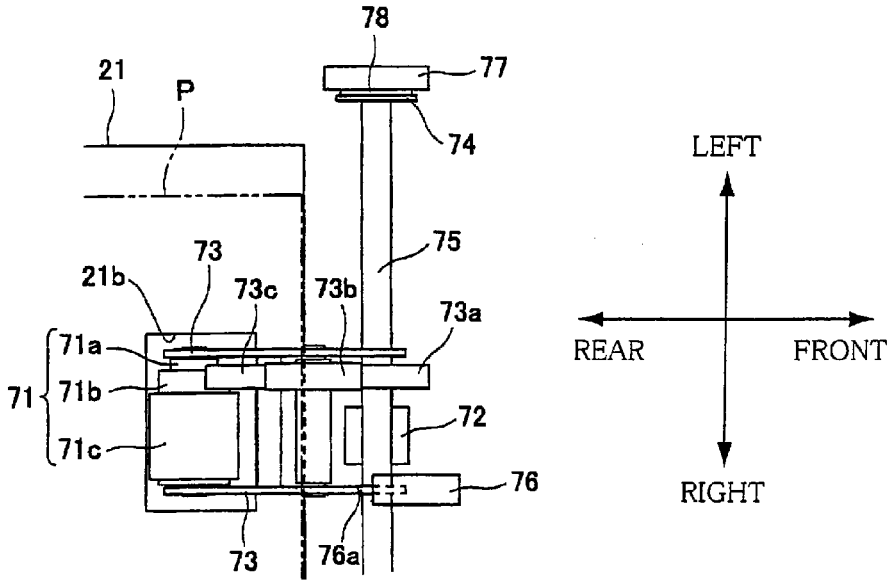
FIG. 4B is a view of the sheet unloading feeder as seen from its lower side.
Figure 5:
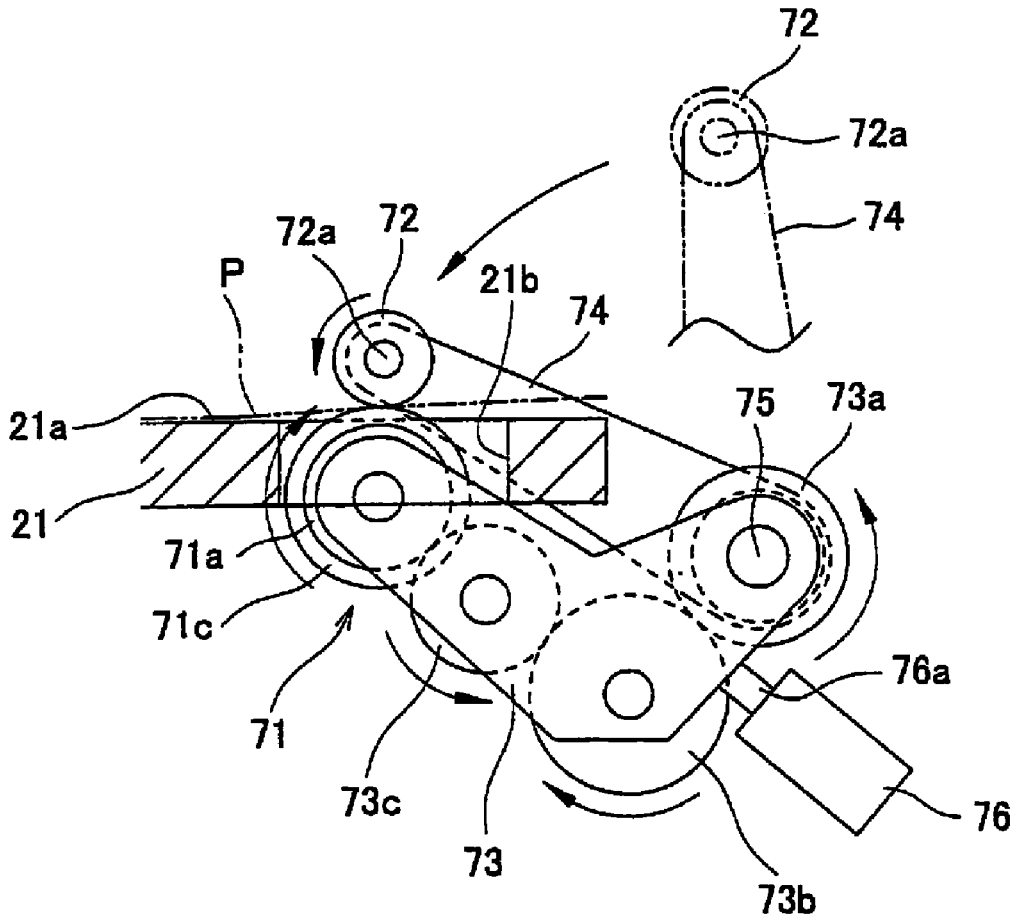
FIG. 5 is a view showing operation of the sheet unloading feeder for unloading a media sheet P.

FIG. 4A is a cross sectional view showing the sheet unloading feeder 13 and taken along line IVA-IVA in FIG. 1. FIG. 4B is a view of the sheet unloading feeder 13 as seen from its lower side. FIG. 5 is a view showing operation of the sheet unloading feeder 13 for unloading the media sheet P. As shown in FIGS. 4A and 4B, the sheet unloading feeder 13 includes: the above-described sheet unloading roller 71 as a first roller aligned with the through-hole 21 of the platen 21; a nip roller 72 as a second roller cooperating with the sheet unloading roller 71 to nip the media sheet P supported on the platen 21; a first roller holder 73 that rotatably holds the sheet unloading roller 71; a second roller holder 74 that rotatably holds the nip roller 72; a drive shaft 75 that pivotably holds the first and second roller holders 73, 74; a solenoid 76 as a first displacer configured to cause the first roller holder 73 to be pivoted about the drive shaft 75; a gear 77 as second displacer is fixed to a left end portion of the drive shaft 75 as one of opposite end portions of the drive shaft 75; a friction member 78 fixed to a surface of the second roller holder 74 that is opposed to the gear 77. It is noted that each of the first and second roller holders 73, 74 is provided by two plate members. It is noted that the nip roller 72 may be provided by a rowel or spur.

As shown in FIG. 4B, the sheet unloading roller 71 includes: a cylindrical core portion 71*a* rotatably held at its axially opposite end portions by the respective two plate members of the first roller holder 73; a toothed portion (gear) 71*b* fixedly mounted on a part of the core portion 71*a* that is located on a left side of an axially central portion of the core portion 71*a*; and a frictional contact portion 71*c* mounted on another part of the core portion 71*a* that is provided by the axially central portion of the core portion 71*a* and also a portion located on a right side of the axially central portion of the core portion 71*a*. The toothed portion 71*b* and the frictional contact portion 71*a* are axially contiguous to each other. It is noted that the frictional contact portion 71*c* is positioned relative to the through-hole 21*b* such that the above-described center of the through-hole 21*b* is aligned with a center line of the frictional contact portion 71*c* that is parallel with the longitudinal direction of the upper surface 21*a* of the platen 21.

In the present embodiment, the frictional contact portion 71*c* of the sheet unloading roller 71 is made of an elastic material such as rubber. However, the frictional contact portion 71*c* may be made of any other material, as long as the material enables transmission of the rotational force from the sheet unloading roller 71 to the media sheet P when the roller 71 is held in contact with the media sheet P. Further, where a large frictional force is generated between the frictional contact portion 71*c* and the media sheet P, the media sheet P can be moved to the output sheet accommodator 15 only by the rotational force of the sheet unloading roller 71, without the sheet unloading roller 71 cooperating with the nip roller 72 to nip the media sheet P.

In the first roller holder 73, three gears 73*a*, 73*b*, 73*c* are provided to mesh with each other. The gear 73*a* is fixed to the drive shaft 75, while the gears 73*b*, 73*c* are rotatably held by the first roller holder 73. The gear 73*c* meshes with the toothed portion 71*b* of the sheet unloading roller 71. With rotation of the drive shaft 75, a rotational force is given to the gear 73*a*, and then the rotational force is transmitted to the toothed portion 71*b* via the gears 73*b*, 73*c*, whereby the sheet unloading roller 71 as a drive roller is rotated. The drive shaft 75 cooperates with the three gears 73*a*, 73*b*, 73*c* to constitute a rotational force applier.

Specifically described, when the drive shaft 75 is rotated in counterclockwise direction as shown in FIG. 5, the gear 73*a* is also rotated in the counterclockwise direction, and the gear 73*b* meshing with the gear 73*a* is rotated in clockwise direction. With rotation of the gear 73*b* in the clockwise direction, the gear 73*c* meshing with the gear 73*b* is rotated in the counterclockwise direction, and the toothed portion 71*b* meshing with the gear 73*c* is rotated in the clockwise direction. That is, with rotation of the drive shaft 75 in the counterclockwise direction, the sheet unloading roller 71 is rotated in the clockwise direction. In this instance, where the media sheet P is nipped between the sheet unloading roller 71 and the nip roller 72, the rotational force of the sheet unloading roller 71 as the drive roller is effectively transmitted to the media sheet P, whereby the media sheet P is fed in a medium unloading direction D (i.e., feed direction) (see FIG. 1) that is opposite to the medium introducing direction A, so as to be received by the output sheet accommodator 15. Further, since the center of the frictional contact portion 71*c* of the sheet unloading roller 71 and the center of the through-hole 21 are aligned with the center line of the media sheet P that is parallel to the medium unloading direction D, the rotational force applied by the sheet unloading roller 71 acts on the center line of the media sheet P. Therefore, the media sheet P can be moved precisely in the medium unloading direction D rather than in a direction inclined with respect to the medium unloading direction. It is noted that, where the drive shaft 75 is rotated in the opposite direction, i.e., the clockwise direction, the sheet unloading roller 71 is rotated in the counterclockwise direction.

As shown in FIG. 4A, the solenoid 76 has a piston 76*a* that is fixed to one of the two plate members of the first roller holder 73. When the piston 76*a* is placed in its extending position, the first roller holder 73 is pivoted about the drive shaft 75 in clockwise direction, whereby the sheet unloading roller 71 is placed in its projecting position in which the roller 71 projects out from the upper surface 21*a* of the platen 21 through the through-hole 21*b*, as shown in FIG. 5. In this instance, if the media sheet P is supported on the upper surface 21*a* of the platen 21, a leading end portion of the media sheet P (i.e., one of longitudinally opposite end portions that is closer to the output sheet accommodator 15) is raised by the sheet unloading roller 71 so as to be separated from the upper surface 21*a*. On the other hand, when the piston 76*a* is placed in its retracted position, the first roller holder 73 is pivoted about the drive shaft 75 in counterclockwise direction, whereby the sheet unloading roller 71 is placed in its non-projecting position in which the roller 71 does not project out from the upper surface 21*a* of the platen 21, as shown in FIG. 4A.

The nip roller 72 is rotated about a center shaft 72*a* which extends in the direction of width of the platen 21 (i.e., direction perpendicular to the medium unloading direction D) and which is rotatably held at its opposite end portions by the respective two plate members of the second roller holder 74. Like the first roller holder 73, the second roller holder 74 is rotatably held by the drive shaft 75 that extends in parallel to the center shaft 72*a*. That is, the first and second roller holders 73, 74 are pivotable about the drive shaft 75 as a common shaft, whereby the media sheet P can be nipped between the sheet unloading roller 71 and nip roller 72 in a position that is substantially constant.

The friction member 78 is arranged to be contactable with a surface of the gear 77 that is opposed to the second roller holder 74. A rotational force is transmitted from the gear 77 to the second roller holder 74 through the friction member 78, while a resistance acting against pivot movement of the second roller holder 74 is not larger than a predetermined threshold. Specifically described, when the gear 77 is rotated in counterclockwise direction, the second roller holder 74 is pivoted in the in counterclockwise direction, as shown in FIG. 5, owing to contact of the friction member 78 with the gear 77. In this instance, where the sheet unloading roller 71 is placed in the projecting position so as to project out from the upper surface 21*a* of the platen 21, the leading end portion of the media sheet P separated from the upper surface 21*a* is nipped by the sheet unloading roller 71 and the nip roller 72. With rotation of the sheet unloading roller 71 in the clockwise direction, the rotational force is effectively transmitted from the sheet unloading roller 71 to the media sheet P, owing to cooperation of the sheet unloading roller 71 and nip roller 72 for nipping the media sheet P therebetween, for thereby making it possible to stably feeding the media sheet P.

Where the resistance acting against pivot movement of the second roller holder 74 is larger than the predetermined threshold, due to nipping of the media sheet P between the two rollers 71, 72, the rotational force is not transmitted between the gear 77 and the second roller holder 74, so that each of the gear 77 and the second roller holder 74 is rotated relative to the other of the gear 77 and the second roller holder 74. That is, the drive shaft 75 and the gear 77 are loosely rotated relative to the second roller holder 74 and the friction member 78.

It is noted that the nip roller 72 is rotated together with feed movement of the media sheet P since the nip roller 72 is arranged to be freely rotatable. That is, the nip roller 72 as a driven roller is rotated by its contact with the media sheet P that is fed by rotation of the sheet unloading roller 71. On the other hand, when the gear 77 is rotated in the opposite direction, i.e., the clockwise direction, the second roller holder 74 is pivoted in the clockwise direction whereby the nip roller 72 is displaced to its non-nipping position, as shown in FIG. 4A, for thereby releasing nipping of the media sheet P by the nip roller 72 and the sheet unloading roller 71.

Referring back to FIG. 1, there will be described construction of the inkjet heads 2 in detail. As shown in FIG. 1, each of the two inkjet heads 2 has a rectangular shape, as seen in the plan view, which is elongated in the width direction of the platen 21 (i.e., direction perpendicular to the medium introducing direction A). The two inkjet heads 2 are arranged in the longitudinal direction of the platen 21, and are fixed to a frame 3, so that the two inkjet heads 2 cooperate with the frame 3 to constitute a head unit 4 that is elongated in the width direction of the platen 21. Each of the inkjet heads 2 has a nozzle opening surface 2*a* that is opposed to the upper surface 21*a* of the platen 21. A plurality of nozzles 5 open in the nozzle opening surface 2*a*, are arranged in two rows 6 each extending in the width direction of the platen 21.

As shown in FIG. 1, the plurality of nozzles 5 forming each of the two rows 6 are arranged in the width direction of the platen 21 at a constant spacing pitch that corresponds to a required degree of resolution. Two of the nozzles 5, which are located in respective opposite ends of each of the two rows 6, are located in respective positions that are slightly outside widthwise opposite ends of the media sheet P, whereby a marginless printing can be performed on the media sheet P.

Further, a permissible tolerance in positioning of the media sheet P relative to the platen 12 can be increased by the above-described arrangement in which the opposite end nozzles 5 of each row 2 are located in the respective positions that are outside the media sheet P rather than being opposed to the media sheet P. This is because, even if the media sheet P is somewhat deviated from a desired position defined by the longitudinally extending portion 41 of the stopper in the width direction of the platen 21, the nozzles 5 are present in positions opposed to the widthwise opposite ends of the media sheet P.

In the present embodiment, four color inks (e.g., magenta, cyan, yellow and black inks) are ejected through the plurality of nozzles 5. The magenta ink is ejected through the nozzles 5 forming the frontmost one of the rows 6 (i.e., the uppermost one of the rows 6 as seen in FIG. 1), the cyan ink is ejected through the nozzles 5 forming the second frontmost one of the rows 6, the yellow ink is ejected through the nozzles 5 forming the second rearmost one of the rows 6, and the black ink is ejected through the nozzles 5 forming the rearmost one of the rows 6.

The above-described degree of resolution corresponding to the nozzle spacing pitch in the inkjet heads 2 is precisely determined by a distance between each adjacent pair of points at which a widthwise extending line (not shown) extending in the width direction of the platen 21 intersects with a plurality of longitudinally extending lines (not shown) perpendicular to the widthwise extending line and passing through centers of the respective nozzles 5. In the present embodiment, the nozzles 5 forming each of the rows 6 are assigned to eject therethrough a corresponding one of the four color inks, and arranged straight in parallel to the width direction of the platen 21, so that the degree of resolution is determined by the nozzle spacing pitch between the nozzles 5 as measured in the width direction of the platen 21 in which the rows 6 extend.

The head mover 10 includes a pair of rails 7, 8 and a pair of linear motors 9. The rails 7, 8 are disposed on respective opposite sides of the head unit 4 in the longitudinal direction of the head unit 4, and extend in the width direction of the head unit 4 (i.e., the longitudinal direction of the platen 21). Each of the linear motors 9, which are fixed to the frame 3 of the head unit 4, is disposed on a corresponding one of the rails 7, 8, so as to be movable on the corresponding one of the rails 7, 8. With movements of the linear motors 9 along the respective rails 7, 8 under control of the main controller 100, the head unit 4 (i.e., two inkjet heads 2) are moved relative to the platen 21 in the longitudinal direction of the platen 21 that is parallel to the medium introducing direction A and medium unloading direction D.

The main controller 100 will be described with reference to FIG. 6 that is a functional block diagram of the main controller 1. The main controller 100 incorporates therein: a CPU (central processing unit); a ROM (read only memory) storing control programs executed by the CPU and data used in execution of the control programs; a RAM for temporarily storing data in the execution of the control programs; and other logic circuits. With integral performances of these incorporated elements, there are established functional portions as described below.

Figure 6:
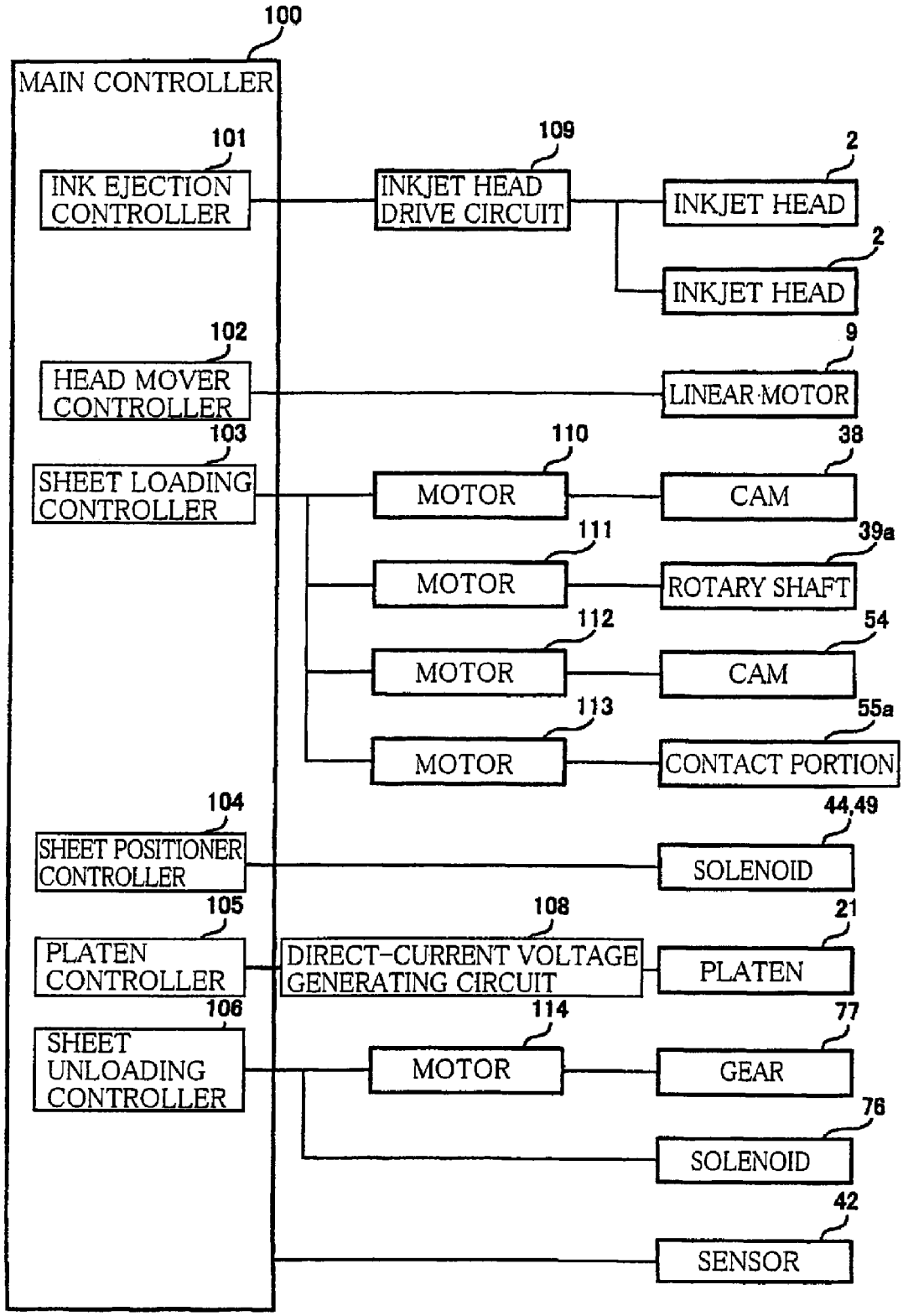
FIG. 6 is a functional block diagram of a main controller of the inkjet printer of FIG. 1.

As shown in FIG. 6, the main controller 100 includes the functional portions in the form of: an ink ejection controller 101; a head mover controller 102; a sheet loading controller 103; a sheet positioner controller 104; a platen controller 105; and a sheet unloading controller 106 as a feeder controller. The above-described sensor 42 disposed on the platen 21 is connected to the main controller 100, so as to detect the media sheet P positioned in the predetermined position on the upper surface 21*a* of the platen 21, for determining whether the media sheet P fed by the loading roller 52 is actually positioned in the predetermined position by the stopper as the medium positioner.

The ink ejection controller 101 is configured to control an inkjet head drive circuit 109, based on data indicative of desired image and received by the main controller 100, so as to cause the ink to be ejected through the nozzles 5 of the inkjet heads 2. The inkjet head drive circuit 109 generates signals commanding ejection of the ink, based on command supplied from the ink ejection controller 101, and the generated signals are supplied to a plurality of actuators (not shown) provided in the inkjet heads 2. Upon supply of the signals thereto, the actuators are operated to apply pressures to the ink within the inkjet heads 2, for thereby causing the pressurized ink is ejected through the nozzles 5. The ink is thus ejected from the inkjet heads 2.

The head mover controller 102 is configured to control operations of the respective linear motors 9 of the head mover 10, so as to cause the linear motors 9 to be moved along the respective rails 7, 8. The sheet loading controller 103 is configured to control operations of respective four motors 110, 111, 112, 113. The motor 110 is operated to rotate the drive shaft 38 of the first loader 18. The motor 111 is operated to rotate the rotary shaft 39*a* of the cam 39 of the first loader 18. The motor 112 is operated to rotate the drive shaft 54 of the second loader 19. The motor 113 is operated to rotate the rotary shaft 55*a* of the cam 55 of the second loader 19. With the operations of the motors 110, 111, 112, 113 under control of the sheet loading controller 103, the media sheet P is loaded onto the upper surface 21*a* of the platen 21 from the input sheet accommodator 14.

The sheet positioner controller 104 is configured to control operation of each of the respective solenoids 44, 49 so as to cause a corresponding one of the longitudinally and widthwise extending portions 41, 45 of the stopper to be placed in a selected one of the projecting position (in which it projects out from the upper surface 21*a* of the platen 21) and the non-projecting position (in which it does not project from the upper surface 21*a* of the platen 21). The platen controller 105 is configured to control the direct-current voltage generating circuit 108 that is provided for applying direct-current voltage between the electrodes disposed in the platen 21, so as to selectively cause the platen 21 to hold the media sheet P (that has been fed onto the upper surface 21*a* of the platen 21) and release the holding of the media sheet P by the platen 21.

The sheet unloading controller 106 is configured to control operation of the solenoid 76 so as to cause the sheet unloading roller 71 to be placed in a selected one of the projecting position (in which it projects out from the upper surface 21*a* of the platen 21) and the non-projecting position (in which it does not project from the upper surface 21*a* of the platen 21), and also to control operation of a motor 114 for rotating the gear 77 so as to cause the nip roller 72 to be displaced between the above-described nipping and non-nipping position. Since the gear 77 and the drive shaft 75 are fixed to each other, the drive shaft 75 is rotated with rotation of the gear 77, whereby the sheet unloading roller 71 is rotated. While the media sheet P is being nipped between the sheet unloading roller 71 and nip roller 72, the media sheet P (supported on the upper surface 21*a* of the platen 21) is unloaded to the output sheet accommodator 15, by rotation of the sheet unloading roller 71 in the clockwise direction (as seen in FIG. 4A).

Figure 7:
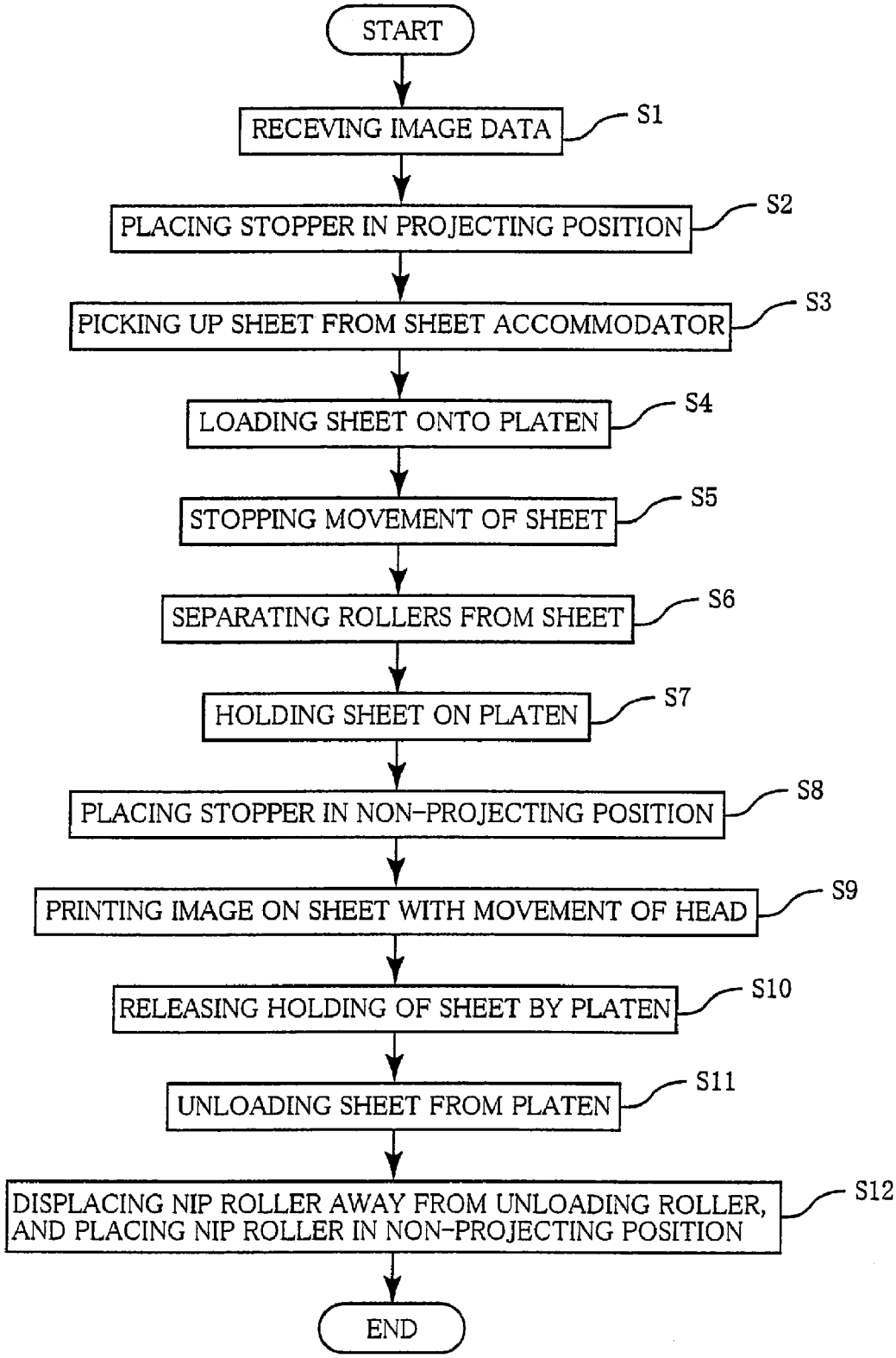
FIG. 7 is a flow chart showing a controlling routine program that is executed in the inkjet printer of FIG. 1.

FIG. 7 is a flow chart showing a controlling routine program that is executed in the inkjet printer 1 upon a printing operation for printing an image on the media sheet P. The routine program is initiated with step S1 in which the main controller 100 receives data indicative of image that is to be formed on one media sheet P. Step S1 is followed by step S2 in which the sheet positioner controller 104 controls operations of the solenoids 44, 49 so as to cause the longitudinally and widthwise extending portions 41, 45 of the stopper to be placed in the respective projecting positions.

Then, in step S3, the sheet loading controller 103 controls operation of the motor 111 so as to cause the cam 39 to be positioned in an angular position, as shown in view (a) of FIG. 3, which causes the pickup roller 36 to be brought into contact with an uppermost one of the media sheets P accommodated in the input sheet accommodator 14. The motor 111 is stopped by the sheet loading controller 103 when the cam 39 is positioned in the angular position that causes the pickup roller 36 to be brought into contact with the uppermost media sheet P. Then, the sheet loading controller 103 controls operation of the motor 110 so as to cause the pickup roller 36 to be rotated for picking up the uppermost media sheet P (with which the pickup roller 36 is held in contact) from the input sheet accommodator 14 and moving the uppermost media sheet P toward the platen 21.

Step S3 is followed by step S4 in which the sheet loading controller 103 controls operation of the motor 113 so as to cause the cam 55 to be positioned in an angular position, as shown in view (a) of FIG. 3, which causes the loading roller 52 to be brought into contact with the media sheet P reaching the upper surface 21*a* of the platen 21. The motor 113 is stopped by the sheet loading controller 103 when the cam 55 is positioned in the angular position that causes the loading roller 52 to be brought into contact with the media sheet P. Then, the sheet loading controller 103 controls operation of the motor 112 so as to cause the loading roller 52 to be rotated for moving the media sheet P (with which the loading roller 52 is held in contact) and bringing the media sheet P into contact with the longitudinally and widthwise extending portions 41, 45 of the stopper.

Next, in step S5, upon detection of the leading end of the media sheet P by the sensor 42 when the leading end and side end of the media sheet P are brought into contact with the longitudinally extending portion 41 widthwise extending portion 45 of the stopper, respectively, the motors 110, 112 are stopped by the sheet loading controller 103 for stopping feed movement of the media sheet P. Owing to this control arrangement, the media sheet P can be positioned substantially in a constant position as the predetermined position, thereby making it possible to improve accuracy of printing performed by the inkjet heads 2. Further, since the media sheet P is positioned by its contact with two portions of the stopper, i.e., the longitudinally and widthwise extending portions 41, 45 of the stopper, it is possible to improve accuracy of positioning of the media sheet P on the upper surface 21*a*. Further, since the sensor 42 is disposed in a position which is close to both of the longitudinally and widthwise extending portions 41, 45 of the stopper and which is located on an upstream side of the longitudinally extending portion 41 of the stopper, the media sheet P can be reliably positioned in the predetermined position on the upper surface 21*a*.

Step S5 is followed by step S6 in which the sheet loading controller 103 controls operations of the motors 111, 113 so as to cause the cams 39, 55 to be positioned in respective angular positions, as shown in view (b) of FIG. 3, which cause the pickup roller 36 and loading roller 52 to be displaced in respective positions that are higher than height of the head unit 4, as shown in view (b) of FIG. 3. The motors 111, 113 are stopped by the sheet loading controller 103 when the cams 39, 55 are positioned in the angular positions that cause the rollers 36, 52 to be displaced in the positions above the head unit 4. It is noted that, where the next media sheet P as a new uppermost media sheet P is to be subsequently loaded to the platen 21, step S6 may be implemented with the pickup roller 36 being held in contact with the uppermost media sheet P accommodated in the input sheet accommodator 14, rather than with the pickup roller 36 being displaced away from the media sheet P, so that the new uppermost media sheet P can be moved toward the platen 21 immediately after the preceding media sheet P has been subjected to a printing operation and unloaded from the platen 21.

Next, in step S7, the platen controller 105 controls the direct-current voltage generating circuit 108 so as to cause the platen 21 to be electrified for applying the attraction force between the media sheet P and the upper surface 21*a* of the platen 21. Owing to this control arrangement, the media sheet P positioned by the longitudinally and widthwise extending portions 41, 45 of the stopper can be reliably held in the predetermined position during the printing operation.

Step S7 is followed by step S8 in which the sheet positioner controller 104 controls operations of the solenoids 44, 49 so as to cause the longitudinally and widthwise extending portions 41, 45 of the stopper to be placed into the respective non-projecting positions. With the two extending portions 41, 45 of the stopper being placed in the non-projecting positions, it is possible to avoid the inkjet heads 2 from being interfered by the stopper during movement of the inkjet heads 2 relative to the platen 21.

Next, in step S9, the head mover controller 102 controls operations of the linear motors 9 so as to cause the head unit 4 to be reciprocatively moved in parallel to the longitudinal direction of the platen 21, in a direction away from a rear side of the printer 1 toward a front side of the printer 1 and a direction away from the front side to the rear side. In this instance, while the nozzle opening surfaces 2*a* of the inkjet heads 2 are opposed to the media sheet P, the ink ejection controller 101 controls the inkjet head drive circuit 109 so as to cause the ink to be ejected through the nozzles 5 toward the media sheet P for thereby forming a desired image with a predetermined degree of resolution. Then, when the reciprocative movement of the head unit 4 is completed, the operations of the linear motors 9 are stopped by the head mover controller 102.

Step S9 is followed by step S10 in which the platen controller 105 controls the direct-current voltage generating circuit 108 so as to stop the electrification of the platen 21, for releasing the holding of the media sheet P by the platen 21.

Next, in step S11, the sheet unloading controller 106 controls operation of the solenoid 76 so as to cause the sheet unloading roller 71 to be placed in the projecting position in which the roller 71 projects out from the upper surface 21*a* of the platen 21, as shown in FIG. 5. In this instance, the leading end portion of the media sheet P as one of its longitudinally opposite end portions is upwardly pressed by the sheet unloading roller 71, as shown in FIG. 5. Then, the motor 114 is rotated by the sheet unloading controller 106, so as to cause the gear 77 to be rotated in the counterclockwise direction as seen in FIG. 5 and accordingly cause the sheet unloading roller 71 to be rotated in the clockwise direction as seen in FIG. 5. In this instance, the second roller holder 74 is pivoted in the counterclockwise direction as seen in FIG. 5, since the friction member 78 is held in contact with the rotated gear 77. Thus, the nip roller 72 to be displaced to its nipping position for cooperating with the sheet unloading roller 71 to nip the media sheet P. The rotational force is applied from the sheet unloading roller 71 to the media sheet P nipped between the two rollers 71, 72, whereby the media sheet P is unloaded from the platen 21 to the output sheet accommodator 15.

Then, step S12 is implemented, after the media sheet P has being moved to the output sheet accommodator 15, the sheet unloading controller 106 inverts direction of the rotation of the motor 114, so as to cause the nip roller 72 to be displaced away from the sheet unloading roller 71 and to be placed in a position that overlaps the drive shaft 75 as seen in the plan view of FIG. 1. Then, the sheet unloading controller 106 stops the rotation of the motor 114, and controls operation of the solenoid 76 so as to cause the sheet unloading roller 71 to be displaced to the non-projecting position in which the roller 71 does not project out from the upper surface 21*a* of the platen 21, as shown in FIG. 4A. Thus, the sheet unloading roller 71 is placed in the non-projecting position except when the media sheet P is to be unloaded to the output sheet accommodator 15, so that the sheet unloading roller 71 does not interfere with the inkjet heads 2 while the inkjet heads 2 are operated to perform the printing operation onto the media sheet P. One cycle of execution of the controlling routine program of FIG. 7 is completed with step S12, whereby the printing operation has been performed onto the media sheet P.

In the inkjet printer 1 constructed as described above, step S11 is implemented to displace the sheet unloading roller 71 to the projecting position so as to cause the leading end portion of the media sheet P to be pressed up from the upper surface 21*a* of the platen 21. That is, step S11 is implemented to forcibly separate, from the upper surface 21*a*, the leading end portion of the media sheet P, which remains sticking onto the upper surface 21*a* due to residual electrostatic charge although the electrification of the platen 21 has been stopped in step S10. Then, by displacing the nip roller 72 to the nipping position for cooperating with the sheet unloading roller 71 to nip the media sheet P, the rotational force is transmitted to the media sheet P. Thus, the media sheet P can be quickly moved by rotation of the sheet unloading roller 71, from the upper surface 21*a* of the platen 21 toward the output sheet accommodator 15.

Further, the media sheet P can be partially separated from the upper surface 21*a* of the platen 21 by the simple arrangement in which the sheet unloading roller 71 is caused to project out from the upper surface 21*a* through the through-hole 21*b*. Further, by causing the sheet unloading roller 71 to be rotated upon or after placement of the unloading roller 71 into the projecting position, the media sheet P can be reliably unloaded from the upper surface 21*a* of the platen 21 toward the output sheet accommodator 15.

Further, since the solenoid 76 and the gear 77 are employed as the respective first and second displacers that are operable to pivot the first and second roller holders 73, 74, respectively, the first and second displacers can be easily constructed.

Figure 8:
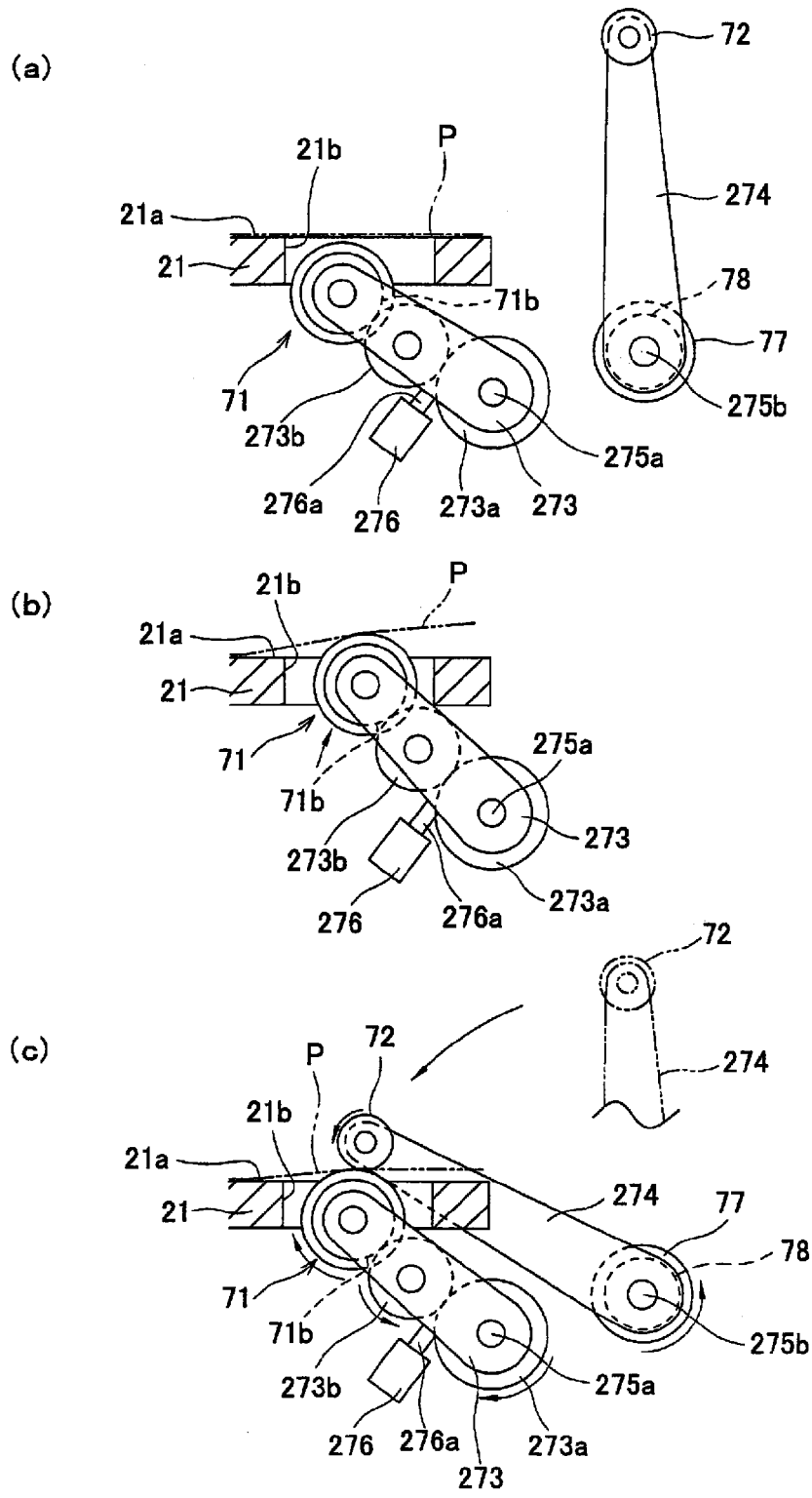
FIG. 8 is a set of views showing operation of a sheet unloading feeder of an inkjet printer constructed according to another embodiment of the invention, wherein view (a) shows a state in which the media sheet P is held on a platen, view (b) shows a state in which the media sheet P held on the platen is partially raised by a sheet unloading roller, and view (c) shows a state in which the media sheet nipped between the sheet unloading roller and a nip roller is being fed.

FIG. 8 is a set of views showing operation of a sheet unloading feeder 213 as the medium feeder of an inkjet printer constructed according to a second embodiment of the invention, wherein view (a) shows a state in which the media sheet P is held on the platen 21, view (b) shows a state in which the media sheet P held on the platen 21 is partially raised by the sheet unloading roller 71, and view (c) shows a state in which the media sheet P nipped between the sheet unloading roller 71 and the nip roller 72 is being fed. The inkjet printer according to this second embodiment is identical with the inkjet printer according to the above-described embodiment as a first embodiment of the invention, except for the sheet unloading feeder 213 that is different in construction from the sheet unloading feeder 13. In the following description, the same reference numerals as used in the first embodiment will be used to identify the same or similar elements, and redundant description of these elements will not be provided.

In the present second embodiment, as shown in view (a) of FIG. 8, the sheet unloading feeder 213 includes two drive shafts 275*a*, 275*b*, a first roller holder 273 and a second roller holder 274. The sheet unloading roller 71 as the first roller is rotatably held by one of opposite end portions of the first roller holder 273. The first roller holder 273 is pivotably held at the other of the opposite end portions by the drive shaft 275*a*. The nip roller 72 as the second roller is rotatably held by one of opposite end portions of the second roller holder 274. The second roller holder 274 is pivotably held at the other of the opposite end portions by the drive shaft 275*b* that extends in parallel to the drive shaft 275*a*. That is, in the sheet unloading feeder 213 of the second embodiment, the first and second roller holders 273, 274 are pivotable about the drive shafts 275*a*, 275*b*, respectively, rather than about a common shaft.

In the first roller holder 273, two gears 273*a*, 273*b* are provided to mesh with each other. The gear 273*a* is fixed to the drive shaft 275*a*, while the gear 273*b* is rotatably held by the first roller holder 273 and meshes with the toothed portion 71*b* of the sheet unloading roller 71. With rotation of the drive shaft 275*a*, a rotational force is given to the gear 273*a*, and then the rotational force is transmitted to the toothed portion 71*b* via the gear 273*b*, whereby the sheet unloading roller 71 is rotated. The drive shaft 275*a* cooperates with the two gears 273*a*, 273*b* to constitute the rotational force applier in this second embodiment.

Specifically described, when the drive shaft 275*a* is rotated in clockwise direction as shown in view (c) of FIG. 8, the gear 273*a* is also rotated in the clockwise direction, and the gear 273*b* meshing with the gear 273*a* is rotated in counterclockwise direction. With rotation of the gear 273*b* in the counterclockwise direction, the toothed portion 71*b* of the sheet unloading roller 71 meshing with the gear 273*b* is rotated in the clockwise direction. That is, with rotation of the drive shaft 275*a* in the clockwise direction, the sheet unloading roller 71 is rotated in the clockwise direction. In this instance, as in the above-described first embodiment, where the media sheet P is nipped between the sheet unloading roller 71 and the nip roller 72, the rotational force of the sheet unloading roller 71 is effectively transmitted to the media sheet P, whereby the media sheet P is fed in the medium unloading direction D, so as to be received by the output sheet accommodator 15. It is noted that, where the drive shaft 275*a* is rotated in the opposite direction, i.e., the counterclockwise direction, the sheet unloading roller 71 is rotated in the counterclockwise direction.

As shown in FIG. 8, to one of the two plate members of the first roller holder 273, there is fixed a piston 276*a* of a solenoid 276 that serves as the first displacer. When the piston 276*a* is placed in its extending position, the first roller holder 273 is pivoted about the drive shaft 275*a* in clockwise direction, whereby the sheet unloading roller 71 is placed in its separating position in which the roller 71 projects out from the upper surface 21*a* of the platen 21 through the through-hole 21*b*, as shown in view (b) of FIG. 8, or in its projecting position in which the roller 71 projects out from the upper surface 21*a* by a distance that is smaller than in the separating position, as shown in view (c) of FIG. 8. In this instance, if the media sheet P is supported on the upper surface 21*a* of the platen 21, the leading end portion of the media sheet P is raised by the sheet unloading roller 71 so as to be separated from the upper surface 21*a*. On the other hand, when the piston 276*a* is placed in its retracted position, the first roller holder 273 is pivoted about the drive shaft 275*a* in counterclockwise direction, whereby the sheet unloading roller 71 is placed in its non-projecting position in which the roller 71 does not project out from the upper surface 21*a* of the platen 21, as shown in view (a) of FIG. 8.

The gear 77 as the second displacer is fixed to an end portion of the drive shaft 275*b*, and the friction member 78 is arranged to be contactable with a surface of the gear 77 that is opposed to the second roller holder 274. As in the first embodiment, a rotational force is transmitted from the gear 77 to the second roller holder 274 through the friction member 78, while a resistance acting against pivot movement of the second roller holder 274 is not larger than a predetermined threshold. Specifically described, when the gear 77 is rotated in counterclockwise direction, the second roller holder 274 is pivoted in the in counterclockwise direction, as shown in view (c) of FIG. 8, owing to contact of the friction member 78 with the gear 77. In this instance, where the sheet unloading roller 71 is placed in the projecting position so as to project out from the upper surface 21*a* of the platen 21, the leading end portion of the media sheet P separated from the upper surface 21*a* is nipped by the sheet unloading roller 71 and the nip roller 72. With rotation of the sheet unloading roller 71 in the clockwise direction, the rotational force is effectively transmitted from the sheet unloading roller 71 to the media sheet P, owing to cooperation of the sheet unloading roller 71 and nip roller 72 for nipping the media sheet P therebetween, for thereby making it possible to stably feeding the media sheet P. Where the resistance acting against pivot movement of the second roller holder 274 is larger than the predetermined threshold, due to nipping of the media sheet P between the two rollers 71, 72, the rotational force is not transmitted between the gear 77 and the second roller holder 274, so that each of the gear 77 and the second roller holder 274 is rotated relative to the other of the gear 77 and the second roller holder 274. That is, the drive shaft 275*b* and the gear 77 are loosely rotated relative to the second roller holder 274 and the friction member 78.

On the other hand, when the gear 77 is rotated in the opposite direction, i.e., the clockwise direction, the second roller holder 274 is pivoted in the clockwise direction whereby the nip roller 72 is displaced to its non-nipping position, as shown in view (a) of FIG. 8, for thereby releasing nipping of the media sheet P by the nip roller 72 and the sheet unloading roller 71.

Like in the first embodiment, the main controller 100 includes the ink ejection controller 101, the head mover controller 102, the sheet loading controller 103, the sheet positioner controller 104, the platen controller 105 and the sheet unloading controller 106 as the feeder controller. However, in the present second embodiment, the sheet unloading controller 106 is configured slightly differently from in the first embodiment.

In this second embodiment, the sheet unloading controller 106 is configured to control operation of the solenoid 76 so as to cause the sheet unloading roller 71 to be placed in a selected one of the projecting position (in which it projects out from the upper surface 21*a* of the platen 21), the separating position (in which it projects out from the upper surface 21*a* of the platen 21 by a distance that is larger than in the projecting position) and the non-projecting position (in which it does not project from the upper surface 21*a* of the platen 21), and also to control operation of a motor for rotating the gear 77 so as to cause the nip roller 72 to be displaced between the above-described nipping and non-nipping position. Further, the sheet unloading controller 106 is configured to control operation of a motor for rotating the drive shaft 275*a*, so as to cause the media sheet P nipped between the sheet unloading roller 71 and nip roller 72, to be unloaded to the output sheet accommodator 15.

The controlling routine program executed in the present second embodiment is substantially identical with that executed in the first embodiment with respect to steps S1-S10. The following is descriptions as to procedures made after implementation of step S10 in which the platen controller 105 controls the direct-current voltage generating circuit 108 so as to stop the electrification of the platen 21, for releasing the holding of the media sheet P by the platen 21.

After implementation of step S10, the sheet unloading controller 106 is operated to control operation of the solenoid 276 so as to cause the sheet unloading roller 71 to be first placed in the separating position as shown in view (b) of FIG. 8 and then placed in the projecting position as shown in view (c) of FIG. 8. As described above, when being placed in the separating position, the sheet unloading roller 71 projects out from the upper surface 21*a* of the platen 21 by the distance that is larger than in the projecting position, so that the leading end portion of the media sheet P is largely raised by the sheet unloading roller 71 with placement of the roller 71 in the separating position. Thus, the leading end portion of the media sheet P can be reliably separated from the upper surface 21*a* of the platen 21.

Then, the sheet unloading controller 106 controls operation of the motor for rotating the gear 77 so as to cause the gear 77 to be rotated in the counterclockwise direction. In this instance, the second roller holder 274 is pivoted together with rotation of the gear 77, owing to contact of the friction member 78 with the rotated gear 77, in the counterclockwise direction as shown in view (c) of FIG. 8. That is, the nip roller 72 is displaced to the nipping position for cooperating with the sheet unloading roller 71 to nip the media sheet P. When the nip roller 72 has been displaced to the nipping position, the motor for rotating the gear 77 is stopped by the sheet unloading controller 106.

Then, the sheet unloading controller 106 controls operation of the motor for rotating the drive shaft 275*a* so as to cause the drive shaft 275*a* and the gear 273*a* (that is fixed to the drive shaft 275*a*) to be rotated in the clockwise direction as shown in view (c) of FIG. 8. With rotation of the gear 273*a* in the clockwise direction, the sheet unloading roller 71 is rotated also in the clockwise direction whereby the rotational force is applied from the sheet unloading roller 71 to the media sheet P that is nipped between the sheet unloading roller 71 and the nip roller 72. The media sheet P is thus unloaded to the output sheet accommodator 15.

When the media sheet P has been unloaded from the uppers surface 21*a* of the platen 22 to the output sheet accommodator 15, the sheet unloading controller 106 is operated to control operation of the motor for rotating the gear 77 in the clockwise direction so as to cause the nip roller 72 is displaced away from the sheet unloading roller 71 as shown in view (a) of FIG. 8. Then, the sheet unloading controller 106 stops the rotation of the motor (that is provided for rotating the drive shaft 275*a*), and controls operation of the solenoid 276 so as to cause the sheet unloading roller 71 to be displaced to the non-projecting position as shown in view (a) of FIG. 8. One cycle of execution of the controlling routine program is thus completed.

While the preferred embodiments of this invention have been described above, it is to be understood that the invention is not limited to the details of the illustrated embodiments, but may be embodied with various changes and modifications, which may occur to those skilled in the art, without departing from the sprit and scope of the present invention.

For example, in the above described embodiments, two of the nozzles 5, which are located in the respective opposite ends of each of the two rows 6, are located in the respective positions that are slightly outside the widthwise opposite ends of the media sheet P. However, if the printer is not required to perform a marginless printing, it is not necessary to provide the nozzles 5 that are located in the respective positions that are outside the widthwise opposite ends of the media sheet P.

The center of the through-hole 21*b* does not necessarily have to be aligned with the center line of the media sheet P (that is parallel to the longitudinal direction of the media sheet P), for example, where a guide is provided to extend from the platen 15 to the output sheet accommodator 15 in the longitudinal direction of the media sheet P. Even if the media sheet P were moved in a direction inclined with respect to a correct direction, i.e., the medium unloading direction D, such an inclination could be corrected by the provision of the guide. Further, the first displacer does not necessarily have to be provided by the solenoid 76 or solenoid 276 but may be provided by another element such as gear, cam or combination of the gear and cam, as long as the first displacer is capable of displacing the sheet unloading roller 71 between the above-described projecting position and non-projecting portion. Further, the second displacer does not necessarily have to be provided by the gear 77 but may be provided by another element such as solenoid, cam or combination of the solenoid and cam, as long as the second displacer is capable of displacing the nip roller 72 between the above-described nipping position and non-nipping position. Further, in the first embodiment, too, the sheet unloading roller 71 may be displaced to the projecting position from the non-projecting position via the separating position, as in the second embodiment.

Further, the cams 39, 55 of the sheet loading feeder 12 are not essential as long as the sheet loading feeder 12 has a construction enabling the media sheet P to be loaded onto the upper surface 21*a* of the platen 21. Further, the inkjet heads 2 may be elongated in the longitudinal direction of the platen 21. In this modified arrangement, since the nozzle opening surfaces 2*a* are elongated also in the longitudinal direction of the platen 21, it is preferable that the nozzles 5 are arranged in rows extending in the longitudinal direction of the platen 21.

Further, the head mover 10 may be configured to move the head unit 4 in the width direction of the platen 21. Further, the platen 21 may be elongated in the direction perpendicular to the medium introducing direction A. In this modified arrangement, it is preferable that the tray 14*a* is elongated in the same direction perpendicular to the medium introducing direction A. Further, the stopper (provided by the longitudinally and widthwise extending portions 41, 45) is not essential. Where the stopper is not provided, the sheet positioner controller 104 may not be provided, either. Further, the medium positioner for positioning the media sheet P in the position on the plate 21 may be provided by an element or elements other than the stopper. Further, the sensor 42 may not be provided.

Further, like the shaft about which the loading roller 52 of the second loader 19 is rotatable, the shaft about which the pickup roller 36 of the first loader 18 is rotatable may be slightly inclined with respect to the medium introducing direction A. Further, in the above-described embodiments, the attraction force applier is provided by the direct-current voltage generating circuit 108 so that the media sheet P is electrostatically held down on the platen 21 that is electrified. However, the attraction force applier is not particularly limited, but may be provided by other kind of device such as a negative pressure applier that is arranged to apply a negative pressure as the attraction force, for example, via through-holes opening in the upper surface 21*a* of the platen 21. Further, the present invention is applicable to any one of other printers each having an inkjet head and a sheet feeding mechanism that are different in construction from those in the above-described embodiments, as long as the printer is equipped with a medium feeder and a medium supporter that are defined in the following claims:

What is claimed is:

1. An inkjet recording apparatus comprising:

a medium supporter configured to support a recording medium that is to be in close contact with a flat surface of said medium supporter;

an inkjet head having a nozzle opening surface that is opposed to said flat surface of said medium supporter;

a medium feeder including a first roller and a second roller that are configured to cooperate with each other to nip the recording medium supported on said flat surface of said medium supporter, thereby the medium feeder being configured to feed the recording medium outwardly of said flat surface of said medium supporter;

said first roller being displaceable between a projecting position and a non-projecting position, such that said first roller projects up from said flat surface of said medium supporter when said first roller is placed in the projecting position, and such that said first roller does not project up from said flat surface when said first roller is placed in the non-projecting position;

said second roller being displaceable toward and away from said first roller; and a feeder controller configured to control said medium feeder, for causing said first roller to be placed in the projecting position, causing said second roller to be displaced toward said first roller upon placement of said first roller in the projecting position so as to cooperate with said first roller to nip the recording medium, and causing at least one of said first and second rollers to be rotated, whereby the recording medium is fed outwardly of said flat surface while the recording medium is being at least partially separated from said flat surface by the placement of said first roller in the projecting position.

2. The inkjet recording apparatus according to claim 1, further comprising an ink ejection controller configured to control said inkjet head, to cause ink to be ejected through nozzles disposed in said nozzle opening surface, toward the recording medium supported on said flat surface of said medium supporter.

3. The inkjet recording apparatus according to claim 1, wherein said medium supporter has a through-hole that opens in said flat surface, and wherein said first roller projects out from said flat surface through said through-hole during the placement of said first roller in the projecting position.

4. The inkjet recording apparatus according to claim 3, wherein said through-hole has a center aligned with a center line of the recording medium that is parallel with a feed direction in which the recording medium is to be fed by said medium feeder.

5. The inkjet recording apparatus according to claim 3, wherein said through-hole has a center aligned with a center line of said flat surface that is parallel with a feed direction in which the recording medium is to be fed by said medium feeder.

6. The inkjet recording apparatus according to claim 1, wherein said medium feeder includes (i) a rotational force applier configured to apply a rotational force to said at least one of said first and second rollers such that the recording medium is fed by rotation of said at least one of said first and second rollers, (ii) a roller holder holding said first roller and displaceable to cause said first roller to selectively move between the projecting position and the non-projecting position, and (iii) a displacer configured to displace said roller holder so as to position said first roller in a selected one of the projecting position and the non-projecting position, and wherein said feeder controller is configured to control said displacer, for causing said first roller to be placed in the projecting position, and to control said rotational force applier, for causing said at least one of said first and second rollers to be rotated during placement of said first roller in the projecting position.

7. The inkjet recording apparatus according to claim 6, wherein said rotational force applier is configured to apply the rotational force to said first roller as a drive roller whereby said first roller is rotated by the rotational force applied thereto, and wherein said second roller is a driven roller rotatable by contact thereof with the recording medium that is fed by the rotation of said first roller as said drive roller.

8. The inkjet recording apparatus according to claim 6, wherein said feeder controller is configured to control said displacer, to cause said first roller to be placed into the non-projecting position from the projecting position, after the recording medium is fed outwardly of said flat surface of said medium supporter.

9. The inkjet recording apparatus according to claim 6, wherein said medium feeder includes, in addition to said rotational force applier, said roller holder as a first roller holder and said displacer as a first displacer, (iv) a second roller holder holding said second roller and displaceable thereby causing said second roller to be displaced selectively toward or away from said first roller, and (v) a second displacer configured to displace said second roller holder so as to displace said second roller in a selected one of a direction toward said first roller and a direction away from said first roller, and wherein said feeder controller is configured to control said second displacer, for causing said second roller to be displaced in the direction toward said first roller upon placement of said first roller in the projecting position.

10. The inkjet recording apparatus according to claim 9, wherein said first and second roller holders are pivotable about a common shaft which is parallel to said flat surface of said medium supporter and which is perpendicular to a feed direction in which the recording medium is to be fed by said medium feeder.

11. The inkjet recording apparatus according to claim 9, wherein said feed controller is configured to control said displacer such that, upon placement of said first roller into the projecting position from the non-projecting position, said first roller is displaced to the projecting position from the non-projecting position via a separating position in which said first roller projects out from said flat surface of said medium supporter by a distance that is larger than in the projecting position, for facilitating separation of the recording medium from said flat surface of said medium supporter.

12. The inkjet recording apparatus according to claim 1, further comprising an attraction force applier configured to apply an attraction force between the recording medium and said flat surface of said medium supporter, wherein said attraction force generator stops application of the attraction force while the recording medium is being fed by said medium feeder.

* * * * *